United States Patent [19]

I et al.

[11] Patent Number: 4,859,297

[45] Date of Patent: Aug. 22, 1989

[54] PROCESS FOR DESCALING COLD-ROLLED AND ANNEALED STAINLESS STEEL STRIP

[75] Inventors: Kanji I; Tatsuo Kawasaki; Eiko Yasuhara, all of Chiba, Japan

[73] Assignee: Kawasaki Steel Corp., Kobe, Japan

[21] Appl. No.: 279,416

[22] Filed: Dec. 2, 1988

[30] Foreign Application Priority Data

Dec. 3, 1987 [JP] Japan ..... 62-304556

[51] Int. Cl.[4] ..... C25F 1/06

[52] U.S. Cl. ..... 204/145 R

[58] Field of Search ..... 204/145 R

[56] References Cited

U.S. PATENT DOCUMENTS 4,129,485 12/1978 Shikata ..... 204/145 R

*Primary Examiner*—T. M. Tufariello

*Attorney, Agent, or Firm*—Austin R. Miller

[57] ABSTRACT

A cold-rolled and annealed stainless steel strip is completely descaled in a short process period by electrolizing the strip with an aqueous solution containing ranges of $$x\ (g/l) = 50 \text{ to } 270 \quad (1)$$

$$y\ (g/l) = (-0.01\ x + 3.8) \text{ to } (-0.05x + 21) \quad (2),$$

where x is concentration of nitric anid in g/l and y is concentration of chlorine in g/l.

2 Claims, 1 Drawing Sheet

PROCESS FOR DESCALING COLD-ROLLED AND ANNEALED STAINLESS STEEL STRIP

BACKGROUND OF THE INVENTION

1. Field of the Invention

This invention relates to a process for descaling cold-rolled and annealed stainless steel strip by electrolytic pickling, and more particularly to a continuous process for removal of scales on the surface thereof in a short time.

2. Description of the Prior Art

So far known methods for continuously descaling cold-rolled stainless steel strip include, for example, as a preparatory step, salt treatment with a molten alkali salt consisting essentially of NaOH or $Na_2CO_3$, or electrolytic treatment in a solution of neutral salt, such as $Na_2SO_4$ or $NaNO_3$, followed by, as main step, the immersion in an aqueous solution of sulfuric acid, nitric acid added hydrogen fluoride, or nitric acid, or electrolytic treatment with an aqueous solution of sulfuric acid or nitric acid. From these methods consisting of immersion or electrolysis which have been disclosed in Japanese Laid-open Patent No. 59-59900a, suitable one is generally applied depending on the extent to which descaling can be made, varying with a kind of steel or annealing conditions of steel to be descaled.

Also in these complex processes, however, it takes a long time for full descaling to be accomplished, and this is still a cause for limited efficiency in production of cold-rolled stainless steel strips. It is troublesome to regulate concentrations of many different salts and acids. Salt treatment is inevitably accompanied by substantial supplement of salt carried away with descaled steel strips.

In an attempt to solve the above-mentioned problems, the inventors made previously a proposal (Japanese Laid-open Patent No. 049197/1987), which has enabled them to descale steels when comparatively difficult to do so, such as SUH409 obtained by annealing at 900° C. or higher temperature on a CAL continuous annealing line, under the condition of 5% of $H_2$ with residue of $N_2$ and dew point of 20° C. below zero. It however is of the socalled two-step-electrolysis system requiring two electrolytic cells and two electrolytic solutions and particularly consisting of electrolysis with a high concentration sulfuric acid solution of 900–1250 g/l in sulfuric acid concentration, followed by with a nitric acid solution containing HCl, $FeCl_3$, NaCl, or the like. Accordingly, it was disadvantageous in having a room to be improved or simplified compared with the one electrolytic-solution descaling technique.

SUMMARY OF THE INVENTION

It is an object of the invention to solve the above-mentioned defects or shortcomings involving the prior art, for instance, low productivity and troublesome control of process, and to provide a simplified and inexpensive process for descaling the cold-rolled and annealed stainless steel strip.

For achieving the above-mentioned object, the invention has been accomplished on the basis of the discovery as a result of study from different aspects that electrolysis with an aqueous solution of nitric acid containing chloride, having respective concentrations within certain concentration ranges, can accomplish the descaling of SUH409 steel strip (obtainable by annealing at temperatures not lower than 900° C. and difficult to be descaled) in a short time without preparatory treatment with salt.

In this way, the invention is characterized by the electrolysis with an aqueous solution of nitric acid containing at least one chloride selected from the group consisting of HCl, NaCl and $FeCl_3$, in which the concentration of nitric acid "x (g/l)" and the concentration of chlorine "y (g/l)" are within the ranges fulfilling the following equations $$x\ (g/l) = 50 \text{ to } 270 \quad (1)$$

$$y(g/l) = (-0.01x + 3.8) \text{ to } (-0.05x + 21) \quad (2)$$

The invention is concerned with the composition of an electrolytic solution for descaling the cold-rolled and annealed steel strip, containing nitric acid as a major component and chloride as an additive, wherein the respective concentrations of nitric acid and chlorine from chloride contained therein are within the ranges fulfilling the above-mentioned equations (1) and (2).

PREFERRED EMBODIMENT OF THE INVENTION

Figure 1:
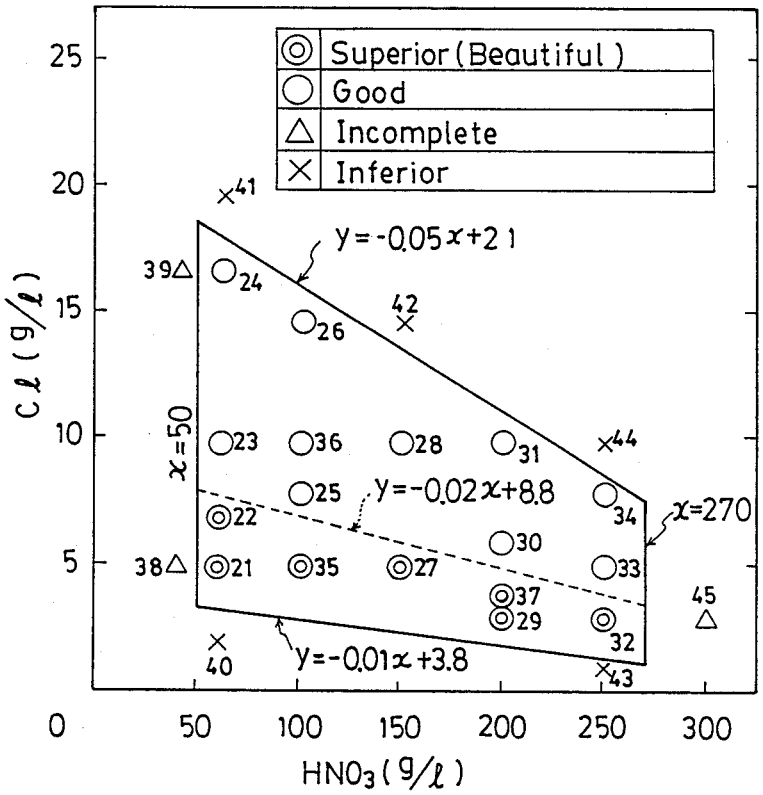
FIG. 1 is a graph illustrating the preferable range of descaling according to the present invention.

SUH409 steel strip obtained by cold-rolling and annealing at 900° C. or higher temperature in the above-mentioned CAL can be descaled at a high speed by electrolysis with an aqueous solution of nitric acid containing chloride, in which the respective concentrations are within the range defined in equations (1) and (2), otherwise high efficient descaling can not be accomplished at any high concentration.

In the process according to the present invention, the concentration of nitric acid is defined to be in the range of from 50 to 270 g/l because the concentration whether below 50 g/l or above 270 g/l, may result in poor descaling ability. Owing to another difficulty encountered in the process that the production of $NO_x$ increases with increasing concentration of nitric acid, a preferable upper limit concentration of nitric acid is about 200 g/l. For obtaining a beautiful descaled surface at a high efficiency, it is preferred for the lower limit of nitric acid concentration to be 100 g/l.

Suitable chlorides to be added to nitric acid solution are HCl, NaCl and $FeCl_3$, and these are effective when used solely or in a combination of at least two of them. They are preferred to be added within the range defined by the following equation $$y\ (g/l) = (-0.01x + 3.8) \text{ to } (-0.05x + 21)$$

wherein x is the concentration of nitric acid and y is the concentration of chlorine, because otherwise, whether exceeding or not reaching the range, poor descaling results. For obtaining a more beautiful descaled surface, it is more preferred to fulfill the following equation $$y\ (g/l) = (-0.01x + 3.8) \text{ to } (-0.02x + 8.8).$$

Suitable temperature of the solution is within the range of 25° C. (room temperature) to 80° C. There is a tendency with higher temperature to be higher in descaling efficiency and on the other hand to increase in production of $NO_x$, and thus the preferable range is between 40° and 65° C.

Descaling efficiency becomes higher with increasing current density and thus is accompanied by more advantageous results. Too large electric current densities lead to adverse results, for example, increased production of $NO_x$ and rough texture. Therefore from 5 to 20 $A/dm^2$ is preferable.

Example

SUH409 and SUS430 steel strips obtained cold-rolled and annealed on CAL were sampled.

The conditions under which these steel strips were annealed and the appearance of the scales are summarized in Table 1. The scale of SUH409 was light yellow blue, and that of SUS430 was brown yellow green. Tables 2 and 3 give the data involving electrolytic pickling in the process according to the invention (Example groups I and II), and those according to conventional processes (Comparative Example groups IA and IIA). The data include composition and temperature of electrolytic solution, electric current density, electrolysis time, and evaluation of descaling effect. In FIG. 1, the data in Table 3 are plotted to depict the relation between the tendency of SUS430 steel to be descaled and contents of acids.

The data of these steel strips involving electrolysis by conventional techniques including $Na_2SO_4$ electrolysis method are given in Table 4 (Comparative Example group IB) and Table 5 (Comparative Example group IIB). The results include electrolysis conditions and evaluation of descaling effects, etc.

All electrolyses of which conditions are given in Tables 2, 3 (FIG. 1), 4 and 5 were carried out in a model pickling tank.

Descaling effects in these Tables were obtained by evaluation with the naked eye in the comparison with the reference sample fully descaled, and indicated using four grades expressed by the symbols:

◎ Superior (Beautiful), ○ Good, Δ Incomplete, and x Inferior.

As apparent from comparison between the results in Tables 2 (Example group I), 3 (Example group II of which the results are plotted in FIG. 1) obtained in the process according to the invention and those in Tables 4-1 (Comparative Example group 1A), 4-2 (Comparative Example group IIA) and 5-1 (Comparative Example group IB) and 5-2 (Comparative Example group IIB), the process according to the invention which includes regulating the concentrations of nitric acid and chlorine from chloride is obviously superior in descaling affect to the conventional techniques. In addition, the quantity of electricity per surface to be descaled was smaller in the process according to the invention than that by the conventional techniques. For example, when SUH409 was sampled, in the process according to the invention $$20A/dm^2 \times 3.2\ sec = 64\ coul/dm^2;$$

in a Comparative Example IB-47,

| | |
|---|---|
| (a) | $Na_2SO_4$ electrolysis<br>$10\ A/dm^2 \times 5\ sec = 50\ coul/dm^2$ |
| (b) | Nitric acid electrolysis<br>$20\ A/dm^2 \times 5\ sec = 100\ coul/dm^2$ |
| Total | $150\ coul/dm^2$. |

Moreover this total quantity of electricity by the conventional technique resulted in insufficient descaling effect. Thus the conclusion can be made that the process according to the invention is obviously superior.

Features of the present invention reside in the use of aqueous solutions of nitric acid containing chloride as an additive, as an electrolytic solution for descaling simply and at a high efficiency the cold-rolled and annealed steel strip, and in regulating its composition. From the view of these, it is a matter of course that the invention can be practiced either solely or in combination within conventional technique.

The present invention can be applied to all type of stainless steels.

As apparent from the above-mentioned Examples, advantages of the present invention are as follows:

(a) One electrolytic solution descaling can be practiced without needing salt-treatment, and this contributes to simplification of process.

(b) Descaling time can be shortened, so that subjects to be descaled can pass at a high speed through electrolytic solution, with improved productivity.

(c) Reduced quantity of electricity per surface compared with prior art, and (d) Substantially-reduced descaling cost resulting from the preceding (a), (b), (c) and (d).

TABLE 1

| Sample | Annealing equipment | Annealing atmosphere | Annealing temperature | Appearance of scale |
|---|---|---|---|---|
| SUH409 steel | CAL | 5% $H_2$, $N_2$ remains, Dew point −20° C. | 910° C. | Light yellow blue (Temper color) |
| SUH430 steel | CAL | 5% $H_2$, $N_2$ remains, Dew Point −20° C. | 910° C. | Brown yellow green (Temper color) |

TABLE 2

| | Sample SUH409 steel | | | | | | | |
|---|---|---|---|---|---|---|---|---|
| | Composition of electrolytic solution | | | | Conditions of electrolysis | | | |
| | | Additive | | | | | | |
| Example No. | $HNO_3$ (g/l) | Kind | Amount added (g/l) | Cl Equivalence (g/l) | Temperature (°C.) | Current density ($A/dm^2$) | Electrolysis time (sec) | Effect of descaling |
| Example group I | | | | | | | | |
| Example 1 | 60 | HCl | 5 | 4.86 | 60 | 20 | 3.2 | ○ |
| 2 | 60 | " | 7 | 6.80 | " | " | " | ○ |
| 3 | 100 | " | 3 | 2.92 | " | " | " | ○ |
| 4 | 100 | " | 7 | 6.80 | " | " | " | ○ |
| 5 | 150 | " | 2.5 | 2.43 | " | " | " | ○ |
| 6 | 150 | " | 7 | 6.80 | " | " | " | ○ |
| 7 | 200 | " | 2 | 1.94 | " | " | " | ○ |

TABLE 2-continued

| Example No. | Sample SUH409 steel: Composition of electrolytic solution: $HNO_3$ (g/l) | Additive: Kind | Additive: Amount added (g/l) | Additive: Cl Equivalence (g/l) | Conditions of electrolysis: Temperature (°C.) | Current density ($A/dm^2$) | Electrolysis time (sec) | Effect of descaling |
|---|---|---|---|---|---|---|---|---|
| 8 | 200 | " | 5 | 4.86 | " | " | " | ○ |
| 9 | 60 | NaCl | 12 | 7.28 | " | " | " | ○ |
| 10 | 100 | " | 10 | 6.07 | " | " | " | ○ |
| 11 | 200 | " | 8 | 4.86 | " | " | " | ○ |
| 12 | 70 | $FeCl_3$ | 10 | 6.56 | " | " | " | ○ |
| 13 | 100 | " | 7 | 4.59 | " | " | " | ○ |
| Comparative Example group IA | | | | | | | | |
| Comparative example 14 | 40 | HCl | 10 | 9.72 | 60 | 20 | 3.2 | X |
| 15 | 60 | " | 3 | 2.92 | " | " | " | X |
| 16 | 60 | " | 20 | 19.44 | " | " | " | Δ |
| 17 | 150 | " | 2 | 1.94 | " | " | " | X |
| 18 | 200 | " | 1 | 0.97 | " | " | " | X |
| 19 | 250 | " | 1 | 0.97 | " | " | " | X |
| 20 | 300 | " | 10 | 9.72 | " | " | " | X |

Remarks
○: good,
Δ: Incomplete,
X: Inferior

TABLE 3

| Example No. | Sample SUS430 steel: Composition of electrolytic solution: $HNO_3$ (g/l) | Additive: Kind | Additive: Amount added (g/l) | Additive: Cl Equivalence (g/l) | Conditions of electrolysis: Temperature (°C.) | Current density ($A/dm^2$) | Electrolysis time (sec) | Effect of descaling |
|---|---|---|---|---|---|---|---|---|
| Example group II | | | | | | | | |
| Example 21 | 60 | HCl | 5 | 4.86 | 60 | 10 | 3.2 | ◎ |
| 22 | 60 | " | 7 | 6.80 | " | " | " | ◎ |
| 23 | 60 | " | 10 | 9.72 | " | " | " | ○ |
| 24 | 60 | " | 17 | 16.52 | " | " | " | ○ |
| 25 | 100 | " | 8 | 7.78 | " | " | " | ○ |
| 26 | 100 | " | 15 | 14.58 | " | " | " | ○ |
| 27 | 150 | " | 5 | 4.86 | " | " | " | ◎ |
| 28 | 150 | " | 10 | 9.72 | " | " | " | ○ |
| 29 | 200 | " | 3 | 2.92 | " | " | " | ◎ |
| 30 | 200 | " | 6 | 5.83 | " | " | " | ○ |
| 31 | 200 | " | 10 | 9.72 | " | " | " | ○ |
| 32 | 250 | " | 3 | 2.92 | " | " | " | ◎ |
| 33 | 250 | " | 5 | 4.86 | " | " | " | ○ |
| 34 | 250 | " | 8 | 7.78 | " | " | " | ○ |
| 35 | 100 | NaCl | 8 | 4.86 | " | " | " | ◎ |
| 36 | 100 | " | 16 | 9.71 | " | " | " | ○ |
| 37 | 200 | " | 6 | 3.64 | " | " | " | ◎ |
| Comparative Example group IIA | | | | | | | | |
| Comparative example 38 | 40 | HCl | 5 | 4.86 | 60 | 10 | 3.2 | Δ |
| 39 | 40 | " | 17 | 16.52 | " | " | " | Δ |
| 40 | 60 | " | 2 | 1.94 | " | " | " | X |
| 41 | 60 | " | 20 | 19.44 | " | " | " | X |
| 42 | 150 | " | 15 | 14.68 | " | " | " | X |
| 43 | 250 | " | 1 | 0.97 | " | " | " | X |
| 44 | 250 | " | 10 | 9.72 | " | " | " | X |
| 45 | 300 | " | 3 | 2.92 | " | " | " | Δ |

Remark
◎: Superior (beautiful)
○: Good
Δ: Incomplete
X: Inferior

TABLE 4-1

| Sample SUH409 steel | Electrolysis, composition of electrolytic solution, temperature, electrolysis conditions (Electrolyses were conducted in the order of (1), (2) and (3)) | | | | | | | |
|---|---|---|---|---|---|---|---|---|
| | $Na_2SO_4$ electrosysis | | | | $H_2SO_4$ electrolysis | | | |
| Example | $Na_2SO_4$ concentration (g/l) | Temperature (°C.) | Electric current density (A/dm$^2$) | (A) Electrolysis time (sec) | $H_2SO_4$ concentration (g/l) | Temperature (°C.) | Electric current density (A/dm$^2$) | (B) Electrolysis time (sec) |
| Comparative Example group IB | | | | | | | | |
| Comparative example 46 | 200 | 80 | 10 | 5 | 100 | 60 | 20 | 5 |
| 47 | 200 | 80 | 10 | 5 | — | — | — | — |

TABLE 4-2

| Sample SUS409 steel | Electrolysis, composition of electrolytic solution, temperature, electrolysis conditions (Electrolyses were conducted in the order of (1), (2) and (3)) | | | | | |
|---|---|---|---|---|---|---|
| | $HNO_3$ electrolysis | | | | | |
| Example | $HNO_3$ concentration (g/l) | Temperature (°C.) | Electric current density (A/dm$^2$) | (C) electrolyses time (sec) | *Total time: (A) + (B) + (C) (sec) | Effect of descaling |
| Comparative Example group IB | | | | | | |
| Comparative example 46 | — | — | — | — | 10 | X |
| 47 | 100 | 60 | 20 | 5 | 10 | X |

Remarks
*Total time taking for electrolysis with $Na_2SO_4$, $H_2SO_4$, and $HNO_3$
X: Inferior

TABLE 5-1

| Sample SUS430 steel | Electrolysis, composition of electrolytic solution, temperature, electrolysis conditions (Electrolyses were conducted in the order of (1), (2) and (3)) | | | | | | | |
|---|---|---|---|---|---|---|---|---|
| | $Na_2SO_4$ electrosysis | | | | $H_2SO_4$ electrolysis | | | |
| Example | $Na_2SO_4$ concentration (g/l) | Temperature (°C.) | Electric current density (A/dm$^2$) | (A) Electrolysis time (sec) | $H_2SO_4$ concentration (g/l) | Temperature (°C.) | Electric current density (A/dm$^2$) | (B) Electrolysis time (sec) |
| Comparative Example group IIB | | | | | | | | |
| Comparative example 48 | 200 | 80 | 10 | 5 | 100 | 60 | 20 | 5 |
| 49 | 200 | 80 | 10 | 5 | — | — | — | — |

TABLE 5-2

| Electrolysis, composition of electrolytic solution, temperature, electrolysis conditions (Electrolyses were conducted in the order of (1), (2) and (3)) | | | | | | |
|---|---|---|---|---|---|---|
| | $HNO_3$ electrolysis | | | | | |
| Example | $HNO_3$ concentration (g/l) | Temperature (°C.) | Electric current density (A/dm$^2$) | (C) electrolyses time (sec) | *Total time: (A) + (B) + (C) (sec) | Effect of descaling |
| Comparative Example group IIB | | | | | | |
| Comparative example 48 | — | — | — | — | 10 | X |
| 49 | 100 | 60 | 20 | 5 | 10 | X |

Remarks
*Total time taking for electrolysis with $Na_2SO_4$, $H_2SO_4$, and $HNO_3$
X: Inferior

What is claimed is:

$$x\ (g/l) = 50 \text{ to } 270 \quad (1)$$

$$y\ (g/l) = (-0.01x + 3.8) \text{ to } (-0.05x + 21) \quad (2)$$

wherein x is the concentration of nitric acid and y is the concentration of chlorine.

2. A process for descaling the cold-rolled and annealed stainless steel strip claimed in claim 1 wherein said chlorine source is composed of at least one chloride selected from the group consisting of HCl, NaCl and $FeCl_3$.

* * * * *

UNITED STATES PATENT AND TRADEMARK OFFICE

CERTIFICATE OF CORRECTION

PATENT NO. : 4,859,297

DATED : 8/22/89

INVENTOR(S) : Kanji 1; Tatsuo Kawasaki; Eiko Yasuhara

It is certified that error appears in the above-identified patent and that said Letters Patent is hereby corrected as shown below:

Column 7, after last line and before equations in column 9, line 1 -

Claim 1 - Entire first part of claim is missing please add the following:

--1. A process for descaling a cold-rolled and annealed stainless steel strip comprising electrolizing the strip with an aqueous solution which has concentrations of nitric acid and chlorine within ranges fulfilling the following equations --.

Signed and Sealed this

Twenty-eighth Day of May, 1991

*Attest:*

HARRY F. MANBECK, JR.

*Attesting Officer*

*Commissioner of Patents and Trademarks*